United States Patent [19]

Kubo

[11] Patent Number: 4,710,111

[45] Date of Patent: Dec. 1, 1987

[54] ROTARY COMPRESSOR WITH OIL GROOVE BETWEEN JOURNAL AND JOURNAL BEARING

[75] Inventor: Masahiro Kubo, Yokohama, Japan

[73] Assignee: Kabushiki Kaisha Toshiba, Kawasaki, Japan

[21] Appl. No.: 837,830

[22] Filed: Mar. 10, 1986

[30] Foreign Application Priority Data

Mar. 14, 1985 [JP] Japan ..... 60-50887

[51] Int. Cl.[4] ..... F04C 18/356; F04C 29/02; F01M 1/00; F16C 33/10

[52] U.S. Cl. ..... 418/63; 418/94; 418/151; 184/6.16; 184/6.18; 384/398

[58] Field of Search ..... 418/63, 94, 151; 184/6.16, 6.18; 384/398

[56] References Cited

U.S. PATENT DOCUMENTS

| | | | |
|---|---|---|---|
| 1,677,780 | 7/1928 | Jaworowski | 418/63 |
| 3,499,600 | 3/1970 | McGregor | 418/94 |
| 3,622,212 | 11/1971 | Laumont | 384/398 |
| 4,626,180 | 12/1986 | Tagawa et al. | 418/63 |

FOREIGN PATENT DOCUMENTS

| | | |
|---|---|---|
| 56-29092 | 3/1981 | Japan . |
| 58-63389 | 4/1983 | Japan . |

OTHER PUBLICATIONS

ISME, Tokyo, chap. 2, Sec. 5; "Recent Developments in Bearing Technology and Their Influence on Marine Propulsion Machinery"; J. Campbell, et al, 1973.

*Primary Examiner*—John J. Vrablik

*Attorney, Agent, or Firm*—Oblon, Fisher, Spivak, McClelland, & Maier

[57] ABSTRACT

A rotary compressor which essentially includes a journal, a compression mechanism including a cylinder and a rolling piston provided on the journal to suck, compress and discharge refrigerant gas by rotating the rolling piston eccentrically in the interior of the cylinder, a motor to drive the journal, a journal bearing to support freely to rotate the journal, and an axial direction oil groove to introduce a lubricating oil into a gap between the journal and the journal bearing, the axial direction oil groove being formed along the axial direction of the journal at a position corresponding to a low pressure area of an oil film of the lubricating oil caused by a deflection of the journal due to the eccentric rotation of the rolling piston.

11 Claims, 11 Drawing Figures

ROTARY COMPRESSOR WITH OIL GROOVE BETWEEN JOURNAL AND JOURNAL BEARING

BACKGROUND OF THE INVENTION

1. Field of the Invention

The present invention relates to a rotary compressor, in particular, to a rotary compressor using journal bearings in a bearing section for supporting its revolving parts.

2. Description of the Prior Art

There is known a rotary compressor in which a rotary comprssion mechanism to suck, compress and discharge gases and a motor to drive it are interlocked together with a journal and incorporated in a single housing. Conventionally the rotary compressor has been widely used for a refrigerator, air conditioner, etc. Since it is relatively easy to minaturize, and also because it is easy to control its compression capacity by means of the variable speed control of the motor.

In recent years, it has been hoped that the rotary compressor can cope with a high-speed rotation of the motor to widen the compression capacity. For performing the high-speed operation of rotary compressors or increasing the rotating speed of motors, any mechanical vibration in the bearing section must be reduced sufficiently and also the durability of the bearing section should be increased.

For the reduction in vibration, it has been known to provide a balancer on a journal so as to compensate for a rotation unbalance of the revolving parts because rolling pistons are eccentrically provided on the revolving parts. Furthermore, for the durability of the bearing section, journal bearings have been used more than ball bearings as the bearing section. A journal bearing is designed to interpose an oil film in a gap between the journal and the journal bearing. The oil film lubricates a mechanical friction surface between the journal and the journal bearing. In the bearing section, an oil groove is defined on the outer surface of the journal or the inner surface of the journal bearing in the axial direction. A lubricating oil is induced to the oil groove and then spreads to the whole bearing surface for making the oil film.

However, another problem remains in the conventional rotary compressor using the journal bearing. That is, the journal deflects in a direction perpendicular to the axis of the journal during its rotation. Because the journal receives centrifugal forces of the piston and the balancer which are both eccentrically mounted on the journal at different axial positions, there exist dynamic inbalances along the length of the journal and the deflection of the journal increases as the rotation speed of the journal increases so that the journal makes contact with the journal bearing against the oil film. Therefore, the deflection of the journal badly effects the bearing section. The deflection of the journal is shown in FIG. 5 and will be described in detail later.

It was difficult to avoid the contact between the journal bearing and the journal in the conventional rotary compressor, and for this reason there were problems that the operating efficiency is lowered, the durability is also deteriorated, and in the worst case it provokes a baking damage of the bearing section.

SUMMARY OF THE INVENTION

An object of the present invention is to provide a novel rotary compressor in which mechanical vibration is reduced and durability is increased.

Another object of the present invention is to provide a novel rotary compressor in which rotation efficiency is improved.

These and other objects of the present invention are achieved in the rotary compressor of the invention which essentially includes a journal having a eccentric portion, a compression mechanism including a cylinder and a rolling piston installed on the journal to suck, compress and discharge refrigerant gas by rotating the rolling piston eccentrically in the interior of the cylinder, a motor to drive the journal, a journal bearing to freely support rotation of the journal, and an axial direction oil groove to introduce a lubricating oil into a gap between the journal and the journal bearing, the axial direction oil groove being formed along the circumference of the journal at positions determined in correspondence to a low pressure area of an oil film of the lubricating oil caused by a deflection of the journal due to dynamic imbalances of the journal including those arising from the eccentricity of the eccentric portion of the rolling piston.

As the result of study on main factors inducing the journal bearing and the journal to come in contact with each other against the oil film of the lubricating oil, the inventor of the present invention has discovered the following.

In the rotary compressor, it is impossible to completely get rid of of a deflection of a journal in the interior of the journal bearing, due to its construction. The deflection mode the journal is determined by the relative relation of the positions of the rolling piston, the bearing sections and the journal as described above, and further in case a balancer is provided, the relative relation of the positions of these three parts is determined, and on the one hand, it is considered that the deflection mode in the rotation surface of a journal is influenced by the progress of the rotating angle of the journal, and takes specific pattern. Therefore, the journal comes nearer to a bearing surface in a specific area of the rotation surface during every rotation, and is cleared from the bearing surface in other areas. In the area where the journal comes nearer to the bearing surface, if the oil film pressure is not high, it results in the contact of both parts. On the contrary, as attention has not been conventionally paid to the position of an axial direction oil groove, there may be a case that the axial direction oil groove is positioned in the area where the journal comes nearer to the bearing surface. Due to the fact that the oil film pressure is low in the axial direction oil groove, nonconformity and contact between both parts was produced. Such problems occur in particular in the ends of the bearing surface.

Additional objects, advantages and features of the present invention will further become apparent to persons skilled in the art from the following description and of the accompanying drawings, in which:

DESCRIPTION OF THE PREFERRED EMBODIMENTS

Figure 1:
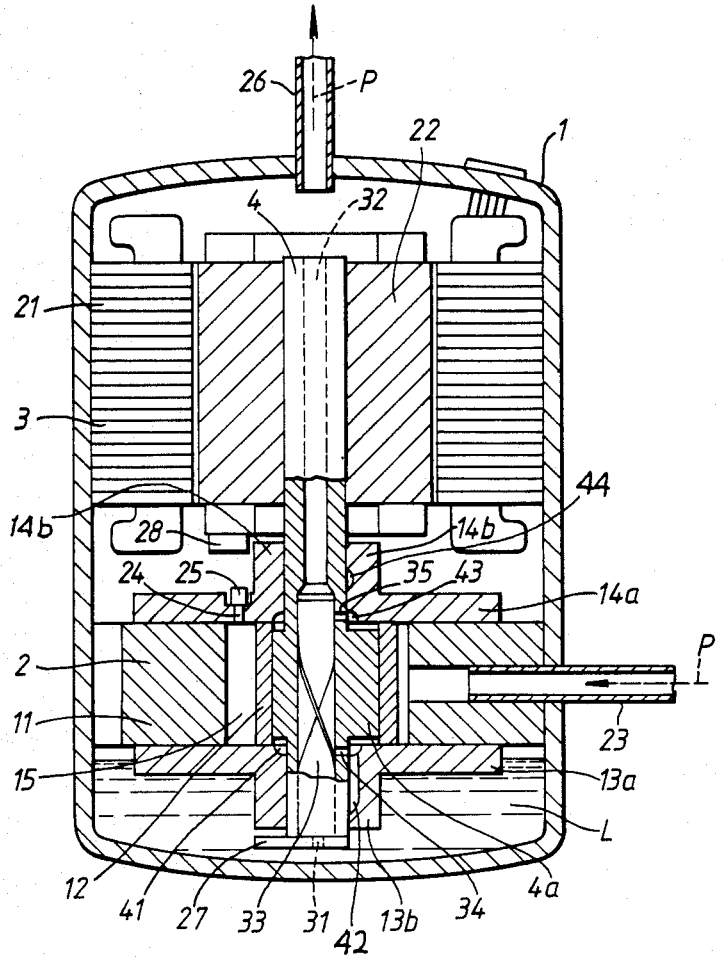
FIG. 1 is a longitudinal section of an embodiment of a rotary compressor according to the present invention.

The present invention will now be described in detail with reference to the accompanying drawings, namely, FIGS. 1 to 11. Throughout the drawings, like reference numerals and letters are used to designate like or equivalent elements for the sake of simplicity of explanation.

FIG. 1 shows an embodiment of the rotary compressor according to the present invention. The rotary compressor is composed by coaxially laying out in an integral way a compression mechanism 2 in the interior of a cylindrical housing 1 whose both ends are closed, a motor 3 to drive compression mechanism 2 and a journal 4 which interlocks revolving parts of both compression mechanism 2 and motor 3.

Compression mechanism 2 includes a cylinder 11 with a columnar space in its central part, an annular rolling piston 12 held in an eccentric section 4*a* of journal 4 at a position in cylinder 11, and a pair of upper and lower journal bearings 13 and 14. Journal bearings 13 and 14 have respectively flange sections 13*a* and 14*a* and bearing sections 13*b* and 14*b*. Flange sections 13*a* and 14*a* close upper and lower ends of cylinder 11 so as to define a compression space 15. Bearing sections 13*b* and 14*b* support journal 4 at the parts where both ends of eccentric section 4*a* of journal 4 are adjacent. Compression space 15 is divided, as shown in FIG. 2, into two by rolling piston 12 and a blade 16 which is slidably mounted to cylinder 11 and reciprocates keep a contact with the external circumference surface of rolling piston 12 in revolving.

Motor 3 is composed of a stator 21 fixed to the inner circumference section of housing 1 and a rotor 22 installed freely to rotate against stator 21 by being supported by journal 4.

Further, a suction pipe 23 penetrates through cylinder 11 to introduce refrigerant gases into compression space 15 from a piping system (not shown). Likewise, a discharge opening 24 and a delivery valve 25 are installed in flange section 14*a* of journal bearing 14 to discharge the gases compressed in compression room 15 out of compression space 15. A delivery pipe 26 to discharge the compresses gases is installed through housing 1 at the edge adjacent motor 3 to the piping system as well.

Figure 2:
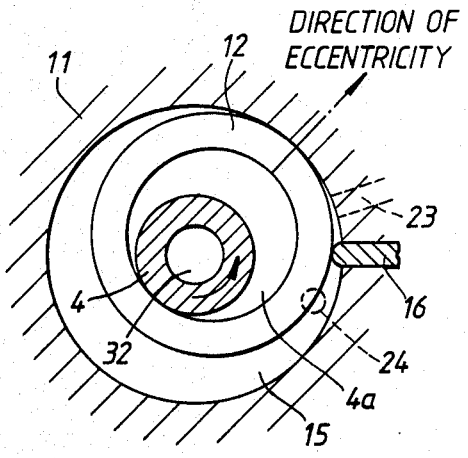
FIG. 2 is a horizontal section of the circumference of a compression mechanism of the rotary compressor according to the present invention.

Suction pipe 23 and dischage opening 24 are respectively located in a relation as shown in FIG. 2 in positions near blade 16 respectively at the rotational direction side of rolling piston 12 and its opposite side in reference to blade 16.

The revolving part of the rotary compressor has attached thereto balancers 27 and 28 in opposite sides in reference to compression mechanism 2. Balancer 27 is fixed to the lower end of journal 4, while balancer 28 is fixed to the lower end of rotor 22 of motor 3. Balancers 27 and 28 compensate for a rotational unbalancing of the revolving part due to the eccentric rotation of eccentric section 4*a* of journal 4 and rolling piston 12.

Now, explanation will be made of an oil lubrication system of the bearing section that is the gist of the present invention.

Journal 4 is defined with an axial hollow 32 at its center axis. Axial hollow 32 reaches an oil sump defined at the bottom end of housing 1 through a suction hole 31 formed in balancer 27. Axial hollow 32 is enlarged in diameter at its lower end corresponding to compression mechanism 2. In the enlarged section of axial hollow 32, a spiral blade 33 is installed. Spiral blade 33 is formed by twisting by 180 degrees a strip-shaped body in the rotational direction of journal 4 so that it scoops up lubricating oil L contained in the oil sump of housing 1 into axial hollow 32 of the journal 4 during the rotation of journal 4. Journal 4 has, furthermore, two lubricating holes 34 and 35 in positions respectively corresponding to lower and upper journal bearings 13 and 14. Lubricating holes 34 and 35 respectively pass through journal 4 in perpendicular to its axis so as to guide lubricating oil L into gaps between lower and upper journal bearings 13, 14 and corresponding portions of journal 4.

Figure 3:
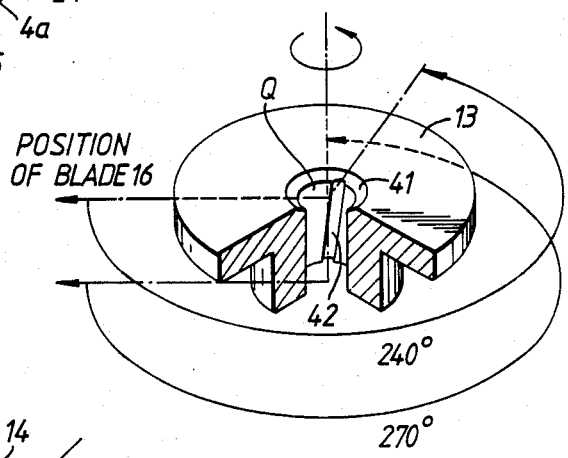
FIGS. 3 and 4 are persepctive, partial sectional views showing the journal bearing of the rotary compressor according to the present invention.

Lower journal bearing 13 is formed with a circumferential oil groove 41 and an axial direction oil groove 42 on its inner surface Q as a bearing surface, as shown in FIG. 3. Circumferential oil groove 41 is formed at one end of lower journal bearing 13 adjacent to compression mechanism 2, while axial direction oil groove 42 is formed spirally along the axis of lower journal bearing 13.

Axial direction oil groove 42 is positioned on bearing surface Q in reference to blade 16 as described below. That is, the upper and lower ends of axial direction oil groove 42 are defined, as shown in FIG. 3, at respective angular positions of 240 degrees and 270 degrees in the system of angular co-ordinates wherein the position of blade 16 is the standard axis and the rotating direction (arrowhead of bold lines in the drawing) of journal 4 is positive.

Figure 4:
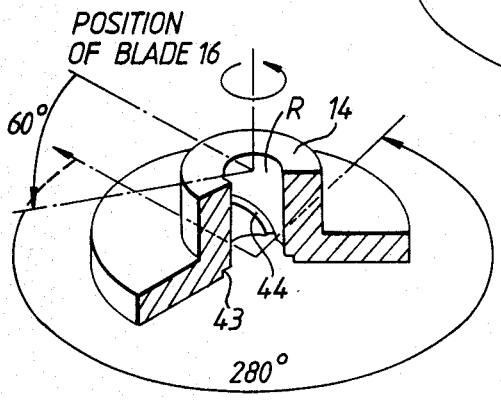

Upper journal bearing 14 is also formed with a circumferential oil groove 43 and an axial direction oil groove 44 on its inner surface R as a bearing surface, as shown in FIG. 4. Circumferential oil groove 43 is formed at one end of lower journal bearing 14 adjacent to compression mechanism 2, while axial direction oil groove 44 is formed spirally along the axis of upper journal bearing 14.

Axial direction oil groove 44 is positioned on bearing surface R in reference to blade 16 as described below. That is, the lower and upper ends of axial direction oil groove 44 are defined, as shown in FIG. 4, at respective angular positions of 280 degrees and 60 degrees in the above-mentioned angular co-ordinates system.

The operation of the rotary compressor thus constituted is described below. When motor 3 is driven, compression mechanism 2 sucks refrigerant gas P from suction pipe 23 to the interior of compression space 15, refrigerant gas P is compressed according to the eccentric rotary motion of rolling piston 12 in compression space 15. Refrigerant gas P thus compressed is dhscharged to the interior of housing 1 through discharge opening 24 and delivery valve 25. Then, refrigerant gas P is exhausted from housing 1 of the rotary compresser to the exterier piping system (not shown) through delivery pipe 26.

The lubrication between journal bearings 13 and 14 and journal 4 is performed as follows. Lubricating oil L contained in the bottom oil sump of housing 1 is introduced into axial hollow 32 of journal 4 through suction hole 31 of balancer 27. Lubricating oil L thus introduced turns with the rotation of spiral blade 33, and is fed to circumferential oil grooves 41 and 43 of journal bearings 13 and 14 through each of lubricating holes 34 and 35 by centrifugal force. In journal bearings 13 and 14, since axial direction oil grooves 42 and 44 are installed in regard to the turning direction of journal 4, when lubricating oil L is fed to circumferential oil grooves 41 and 43, lubricating oil L moves in the direction such that in axial direction oil grooves 42 and 44 it moves away from compression space 15, due to the relative motion between journal 4 and journal bearings 13 and 14.

Figure 5:
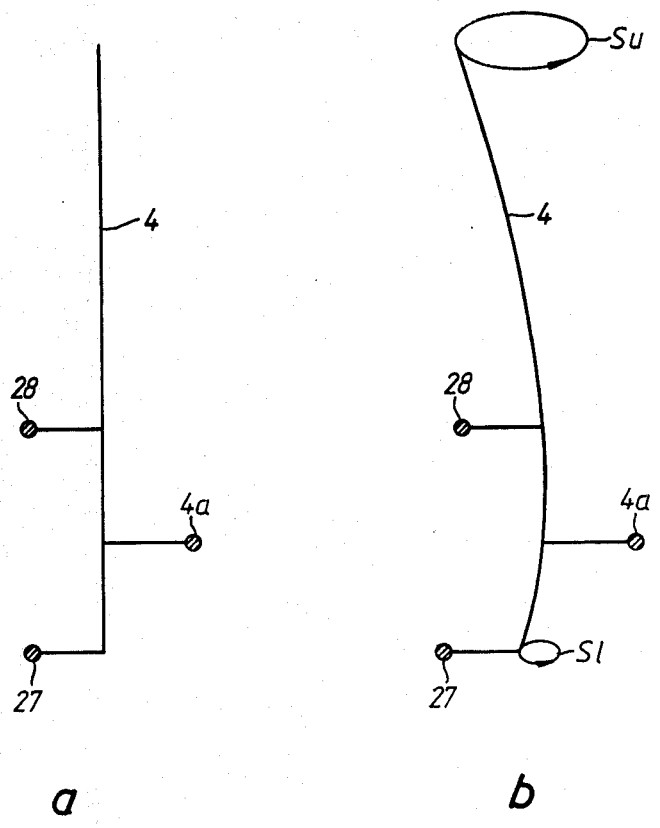
FIGS. 5(*a*) and 5(*b*) are drawings for illustrating the axial deflection mode of the journal of the rotary compressor according to the present invention.

Now, the centers of gravities of the pair of balancers 27, 28, rolling piston 12 and eccentric section 4*a* of journal 4 are relatively positioned as diagramatically shown in FIG. 5(*a*). In FIG. 5(*a*) and FIG. 5(*b*) as described later, the illustrated position refered by 4*a* is assumed to represent the center of gravity of a combination of rolling piston 12 and eccentric section 4*a* of journal 4. When journal 4 rotates at a high-speed, it shows most likely a deflection mode as shown in FIG. 5(*b*) due to the eccentricity of the above respective elements, i.e., balancers 27, 28, rolling piston 12 and eccentric section 4*a* of journal 4. In FIG. 5(*b*), two loops denoted by Su and S1 respectively show deflection locuses of journal 4 at its upper and lower ends. Journal 4 further receives influences of pressure by both blade 16 and refrigerant gas P in compression space 15. Therefore, each section of journal 4 takes a deflection locus of a particular pattern.

Figure 6:
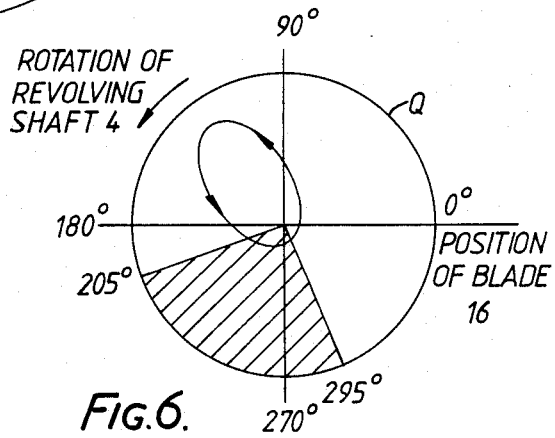
FIG. 6 is a drawing illustrating the locus of the journal of the rotary compressor according to the present invention.

The case of the deflection taken at the position corresponding to the upper end of lower journal bearing 13 is shown as a locus S of an elliptical pattern in FIG. 6. In FIG. 6, a circle denoted by Q represents the inner surface or bearing surface Q of lower journal bearing 13 and the system of angular co-ordinates described before, i.e., the co-ordinates wherein the postion of blade 16 is the zero degree position and the rotating direction of journal 4 is positive, is also shown.

Now, an effect of the deflection of journal 4 taking the particular pattern, e.g., the elliptical pattern locus S will be described in detail below in reference to FIG. 6. As easily understood, a pressure of journal 4 against bearing surface Q of lower journal bearing 13 increases at a position where journal 4 deflects nearer to bearing surface Q. While, the pressure decreases at a position where journal 4 deflects away from bearing surface Q. Therefore, the oil film is required to be sufficiently strong to resist the pressure at the position where journal 4 deflects nearer to bearing surface Q. By the way, the resisting force of the oil film becomes weak at a position where the gap between journal 4 and bearing surface Q is relatively wide. Especially, the strength of the oil film is extremely weak at the position where an axial direction oil groove is defined. On the other hand, the pressure of the oil film increases at an angular position just prior to journal 4 in the rotating direction. Considering those and other reasons, the inventor of the present invention has found that both the area where the oil film must be strong and the other area where it is allowed to be weak may be specified on the bearing surface of the journal bearing in reference to the position of blade 16. For example, the latter area, i.e., the low pressure area of the oil film at the upper end of lower journal bearing 13 is roughly specified in the range of 205 degrees to 295 degress in the angular co-ordinates system shown in FIG. 6. Therefore, the position of the upper end of axial direction oil groove 42 of lower journal bearing 13, i.e., 240 degrees as described before, is of course set in the low pressure area of the oil film. Likewise, low pressure areas at bearing surface Q of lower slide bearing 13 at a bearing surface R of upper slide bearing 14 are also specified. That is, the low pressure area of the oil film at the lower end of lower journal bearing 13 is roughly specified in the range from 180 degrees to 360 degrees. The low pressure area of the oil film at the lower end of upper journal bearing 14 is roughly specified in the range from 225 degrees to 315 degrees. And the low pressure area of the oil film at the upper end of upper journal bearing 14 is roughly specified in the range from 45 degrees to 225 degrees. In accordance with the above, respective positions of the upper end of axial direction oil groove 42 of lower journal bearing 13 and the lower and upper ends of axial direction oil groove 44 of upper journal bearing 14, i.e., 240 degrees, 270 degrees, 280 degrees and 60 degrees as described before in reference to FIGS. 3 and 4, are set in the low pressure areas of the oil films.

Therefore, other areas of the bearing surfaces where the contact of journal 4 with lower and upper journal bearings 13 and 14 are likely to occur are left with high strength for the oil films. Thus, the contact of journal 4 with journal bearings 13 and 14 can be prevented. Further, the oil film pressures around at the areas where axial direction oil grooves 42 and 44 exist become almost negative while journal 4 is rotating. This causes the inducing of lubricating oil L into axial direction oil grooves 42 and 44 from axial hollow 32 of journal 4 comes to be smoothly made.

Moreover, the lubrication performance can be improved by further providing respective journal bearings 13 and 14 with circumferential oil grooves other than 41 and 42 at respective positions corresponding to lubricating holes 34 and 35 of journal 4.

Figure 7:
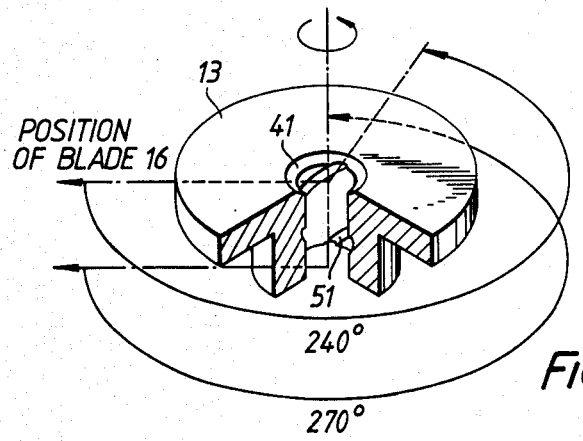
FIGS. 7 and 8 are perspective, partial sectional views showing; other embodiments of the journal bearing of the rotary compressor according to the present invention.
Figure 8:
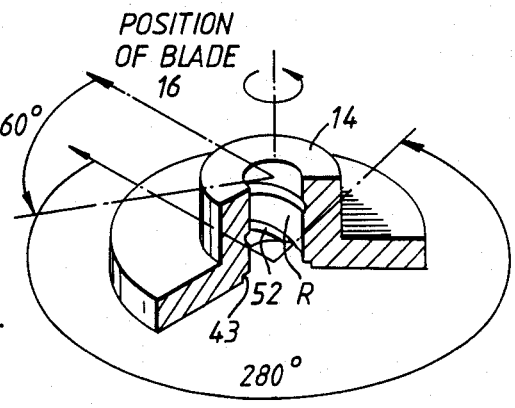

However, this invention shall not be limited to the embodiments described above. FIGS. 7 and 8 show another embodiment in which axial direction oil grooves 51 and 52 formed in journal bearings 13 and 14 are turned more than 1 turn. Even in this case, as the positions of both ends of axial direction oil grooves 51 and 52 are specified in the same positions as the fomerly mentioned embodiment, the effect of the present invention can be taken. And, in this case, the oil supplying function of axial direction oil grooves 51 and 52 can be further strengthened.

Figure 9:
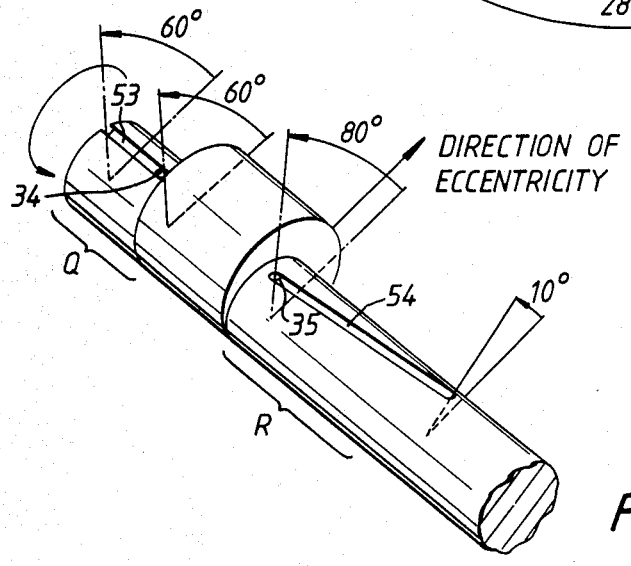
FIGS. 9 to 11 are perspective views to show respectively embodiments of the journal of the rotary compressor according to the present invention.
Figure 10:
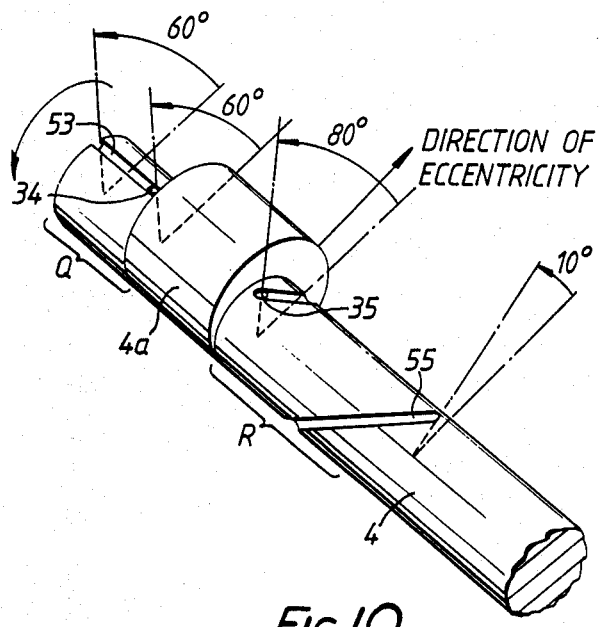

Besides, the present invention shall not be limited in the case of forming axial direction oil grooves at journal bearing side in particular, and for examples, as shown in FIG. 9, it may be good to form axial direction oil grooves 53 and 54 in the outer surface of journal 4. In case the deflection mode of journal 4 is same as that shown in FIG. 5, it is desirable to set the positions of both respective ends of axial direction oil grooves 53 and 54 as follows. When making the direction from the center of journal 4 to the center of the eccentric section 4*a* as a reference and considering the system of angular co-ordinates that the direction to turn the journal (arrowhead in bold line as illustrated) is made positive, the ranges of 0 degrees to 180 degrees, −25 degrees to 75 degrees, 0 degrees to 90 degrees and −15 degrees to 165 degrees in the order from the end of the lower end of journal 4 become the low pressure areas. In the embodiment shown in FIG. 9, they are of 60 degres, 60 degrees, 80 degrees and 10 degrees, respectively, which fulfill the conditions, and the effect of the present invention can be achieved. And, in this case, there is no need to form circumferential oil grooves on journal bearings 13 and 14. Further, also in this case the performance of the oil supplying function can be improved by turning axial direction oil groove 55 more than one turn as shown in FIG. 10.

Figure 11:
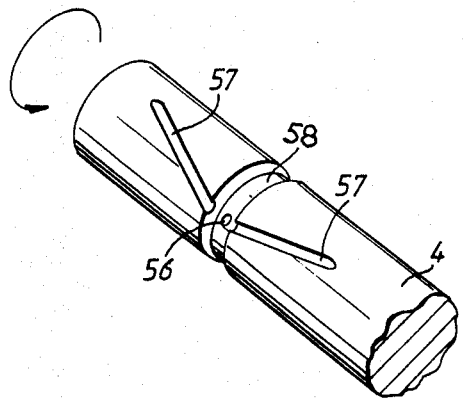

Moreover, lubricating hole 56 of journal 4 may be opened in the intermediate part of axial direction oil groove 57 as shown in FIG. 11. In this case, a circumferential oil groove 58 is defined at a position corresponding to the opening of lubricating hole 56 and respective ends of axial direction oil groove 57 are retreated in the rotating direction of journal 4. So that, the oil supplying function from circumferential oil groove 58 to the respective ends of axial direction oil groove 57 can be smoothly made and effected.

In addition to these, the present invention can be caried out by modifying it in various ways in accordance with the deflection mode of the journal of the rotary compressor. The positions of the axial direction oil groove can be specified only for a particularly required end of the journal bearing, and also in this case the effect of this invention can be achieved.

According to the present invention, since it is a construction that the axial direction oil grooves are not positioned in the high pressure areas of oil film formed in the gap between the journal and journal bearing, there is no way to decrease the oil film pressure in the part where the journal and the journal bearing are most near, which can prevent lowering of the bearing load capacity. Furthermore, according to the present invention, since the axial direction oil grooves are positioned in the areas where the pressure of oil film is allowed to be low, the oil supplying function is accelerated so that the lubricating oil can be smoothly fed to the bearing surface.

Therefore, according to the present invention, the operational efficiency of the rotary compressor and the durability of the bearing section can be improved.

What is claimed is:

1. Rotary compressor comprising:

a journal having an eccentric portion;

compression means including a cylinder and a rolling piston provided on said journal to suck, compress and discharge refrigerant gas by rotating said rolling piston eccentrically in the interior of said cylinder;

a motor to drive said journal;

journal bearing means for freely rotatably supporting said journal; and an axial direction oil groove to introduce a lubricating oil into a gap between said journal and journal bearing means, wherein each axial portion of said axial direction oil groove is positioned on said journal in a circumferential position determined to correspondence to a low pressure area of an oil film of said lubricating oil caused by a deflection of said journal due to dynamic imbalances in said journal, including dynamic imbalances arising from the eccentricity of said rolling piston.

2. Rotary compressor according to claim 1, wherein said journal defines a hollow section penetrating it in the axial direction of said journal, and a lubricating hole passing through said journal to couple said hollow section with an outer surface of said journal to feed said lubricating oil from said hollow section to said gap between said journal bearing means and said journal.

3. Rotary compressor according to claim 2, wherein said journal bearing means has formed at its inner surface a circumferential oil groove in a position corresponding to said lubricating hole.

4. Rotary compressor according to claim 2, wherein said journal is provided with at least one balancer to compensate for the eccentricity of said rolling piston, wherein said dynamic imbalances include those arising from said balancer.

5. Rotary compressor according to claim 4, wherein one said balancer is provided on said journal at each side of said compression means in the axial direction of said journal.

6. Rotary compressor according to claim 4 or 5, wherein said journal bearing means supports said journal at the side of said compression means opposite to said motor and said position of said axial direction oil groove at an end farthest from said compression means is set inthe range of from 180 degress to 360 degrees, in a journal rotational direction, from a blade of said compression means which reciprocates to keep in contact with said rolling piston.

7. Rotary compressor according to claim 4 or 5, wherein said journal bearing means supports said journal at the side of said compression means opposite to said motor and said position of said axial direction oil groove at an end adjacent to said compression means is set in the range of from 205 degrees to 295 degrees, in a journal rotational direction, from a blade of said compression means which reciprocates to keep in contact with said rolling piston.

8. Rotary compressor according to claim 4 or 5, wherein said journal bearing means supports said journal at the position between said compression means and said motor and the position of said axial direction oil groove at an end adjacent to said compression means is set in the range of from 225 degrees to 315 degrees, in a journal rotational direction, from a blade of said compression means which reciprocates to keep in contact with said rolling piston.

9. Rotary compressor according to claim 4 or 5, wherein said journal bearing means supports said journal at the position between said compression means and said motor and the position of said axial direction oil groove at an end adjacent to said motor is set in the range of from 45 degrees to 225 degrees, in a journal rotational direction, from a blade of said compression means which reciprocates to keep in contact with said rolling piston.

10. Rotary compressor according to claim 4, wherein one said balancer is provided at both sides of said compression means.

11. Rotary compressor according to claim 1, wherein said axial direction oil groove is formed by turning at least one turn from one end to another end of said bearing surface.

* * * * *